US009403131B2

(12) United States Patent
Hedlund et al.

(10) Patent No.: US 9,403,131 B2
(45) Date of Patent: Aug. 2, 2016

(54) METHOD FOR DISPENSING SOLID PRODUCTS

(71) Applicant: Ecolab USA Inc., St. Paul, MN (US)

(72) Inventors: Jason D. Hedlund, Lake Elmo, MN (US); John E. Thomas, River Falls, WI (US); Richard Ryan Carroll, Phoenix, AZ (US); Louis Holzman, St. Paul, MN (US); Edward J. Snodgrass, Inver Grove Heights, MN (US); Bernardo Parlange, Minneapolis, MN (US)

(73) Assignee: Ecolab USA Inc., St. Paul, MN (US)

( * ) Notice: Subject to any disclaimer, the term of this patent is extended or adjusted under 35 U.S.C. 154(b) by 455 days.

(21) Appl. No.: 13/827,569

(22) Filed: Mar. 14, 2013

(65) Prior Publication Data

US 2014/0271399 A1 Sep. 18, 2014

(51) Int. Cl.
*B01F 1/00* (2006.01)

(52) U.S. Cl.
CPC ..... *B01F 1/0033* (2013.01)

(58) Field of Classification Search
CPC ..... B01F 1/00; B01F 1/0005; B01F 1/0033
See application file for complete search history.

(56) References Cited

U.S. PATENT DOCUMENTS

| | | | | |
|---|---|---|---|---|
| 2,477,998 | A | | 8/1949 | McCowan |
| 2,624,619 | A | | 1/1953 | Fletcher et al. |
| 4,420,394 | A | | 12/1983 | Lewis |
| 4,438,534 | A | | 3/1984 | Keyes et al. |
| 4,777,670 | A | | 10/1988 | Klinkhammer et al. |
| 4,898,202 | A | * | 2/1990 | Craig ..... 137/268 |
| 5,007,559 | A | | 4/1991 | Young |
| 5,262,132 | A | | 11/1993 | Bricker et al. |
| 5,379,813 | A | | 1/1995 | Ing |
| 5,389,344 | A | | 2/1995 | Copeland et al. |
| 5,441,711 | A | | 8/1995 | Drewery |
| 5,580,448 | A | | 12/1996 | Brandreth |
| 5,932,093 | A | | 8/1999 | Chulick |
| 6,164,042 | A | | 12/2000 | Tobolka |
| 6,247,189 | B1 | | 6/2001 | Dean et al. |
| 6,267,886 | B1 | | 7/2001 | Brandreth, III |
| 6,662,380 | B1 | | 12/2003 | Leonard et al. |

(Continued)

FOREIGN PATENT DOCUMENTS

| | | |
|---|---|---|
| EP | 0413373 B1 | 3/1993 |
| EP | 2125250 B1 | 11/2011 |

(Continued)

OTHER PUBLICATIONS

"Polypropylene". Wikipedia. Screen capture from Feb. 29, 2012.*

(Continued)

*Primary Examiner* — Sean E Conley
*Assistant Examiner* — Donald Spamer
(74) *Attorney, Agent, or Firm* — Fredrikson & Byron, P.A.

(57) ABSTRACT

A method and apparatus for dispensing a solution of a solid product in a fluid. A freestanding apparatus comprises an inlet portion through which fluid enters, a reaction portion in which the fluid encounters and dissolves the product to form a solution, and an outlet portion from which the solution exits the apparatus. Fluid may encounter product from a single direction or multiple directions. The apparatus may be configured to receive a particularly shaped solid product, and may comprise a lid or gate to prevent fluid from contacting the product undesirably.

11 Claims, 9 Drawing Sheets

(56) References Cited

U.S. PATENT DOCUMENTS

| | | | |
|---|---|---|---|
| 6,773,668 | B1 | 8/2004 | Everson et al. |
| 7,069,602 | B1 | 7/2006 | Conway et al. |
| 7,250,086 | B2 | 7/2007 | Furber et al. |
| 7,934,403 | B2 | 5/2011 | Cho et al. |
| 8,230,777 | B2 | 7/2012 | Anson et al. |
| 2003/0205286 | A1 | 11/2003 | Hennemann et al. |
| 2005/0121058 | A1 | 6/2005 | Furber et al. |
| 2007/0214555 | A1 | 9/2007 | Ferrara et al. |
| 2010/0059421 | A1 | 3/2010 | Reed et al. |
| 2010/0239476 | A1 | 9/2010 | King et al. |
| 2012/0001776 | A1 | 1/2012 | Yu et al. |
| 2012/0152813 | A1 | 6/2012 | Stafford |

FOREIGN PATENT DOCUMENTS

| | | | |
|---|---|---|---|
| FR | 2764821 | B1 | 8/1999 |
| JP | H03084130 | A | 4/1991 |

OTHER PUBLICATIONS

International Search Report and Written Opinion for International Application No. PCT/US2014/066818, mailed Feb. 27, 2015, 14 pages.

International Search Report and Written Opinion for International Application No. PCT/US2014/019978, mailed Jul. 8, 2014, 16 pages.

* cited by examiner

METHOD FOR DISPENSING SOLID PRODUCTS

BACKGROUND

Solutions formed from dissolving a solid product in a fluid have been long known and utilized for many applications. Accordingly, solution-forming devices have been developed in order to create desired solutions without the need to manually create them. Instead, a fluid is supplied to the device, the solution is formed therein and then flows out the device. Such devices may be used to create cleaning and sanitizing solutions or other desired solutions.

Many of such solution-forming devices have been in-line systems, in which the device is fixedly connected to the fluid supply. In such a device, fluid will travel through the device whether a solution is desired or not. To prevent unwanted solution formation, either the product must be removed from the device to eliminate the chance of mixing, or alternative routing of the fluid is necessary. Continually removing and replacing the a solid product into the device could be a tedious and annoying task to a user, and rerouting fluid flow may be a costly and/or inconvenient modification to a system.

Additionally, in the case of a potable water supply, it may be necessary to prevent solutions from flowing back into the water supply, as the solutions may be hazardous for consumption. As such, many previous solution-forming devices require some sort of backflow prevention device to prevent the formed solution from flowing back through the device and into the water supply. Such backflow prevention devices, however, add cost and complexity to the design of the solution-forming device.

SUMMARY

Embodiments of the present invention relate to methods and apparatuses for dispensing a solid product in a solution. Apparatuses are generally freestanding comprise an inlet portion in which fluid is directed. From the inlet portion, the fluid flows to a reaction portion, where it encounters the solid product. In the reaction portion, the fluid dissolves the product and forms a solution. The solution then exits the apparatus through an outlet portion.

According to various embodiments of the invention, the product in the reaction portion may be housed in a product guide, which may be shaped to receive a particular product. The product may be covered by a lid to protect it from encountering undesired fluid. The apparatus may additionally comprise a gate, generally disposed between the inlet portion and the product so that it may also prevent fluid from undesirable contacting the product. In some embodiments, the gate may be raised and lowered to control the amount of fluid that passes thereunder and reacts with the product.

Additional embodiments of the invention comprise pegs on which the product sets. The fluid, then, may flow through the pegs and underneath the product, dissolving it from underneath. The invention may also comprise a hull shaped to promote even fluid flow and dissolution of the product as the fluid travels through the reaction portion.

In some embodiments of the invention, fluid flow relatively linearly from one side to the other as it passes the solid product. Other embodiments comprise a wall and an annular channel such that fluid flowing into the apparatus contacts the wall and fills the annular channel, which may at least partially surround the product. Once the fluid level reaches the height of the wall, it spills over into the reaction portion. Thus, if the channel does at least partially surround the product, fluid spilling over therefrom may be incident on the product from multiple directions.

Methods of and apparatuses for dispensing a solid product fall within the scope of the present invention. The details of one or more examples and embodiments of the invention are set forth in the accompanying drawings and the description below. Other features, objects, and advantages will be apparent from the description and the drawings, as well as from the claims of the invention.

DETAILED DESCRIPTION

The present invention is aimed at creating an easy-to-use, cost-effective, and repeatable means for creating solutions of appropriate concentrations. Embodiments of the invention are designed to dispense a solution formed from a solid product and an incident fluid such as water. The solid product may comprise many different products, including but not limited to a sanitizer, a detergent, or a floor care product, as many applications of the present invention may involve creating a solution for a cleaning process. In many cases, it is desirable to achieve and maintain a certain concentration of a solution for cost, performance, or even regulatory reasons.

Figure 1A:
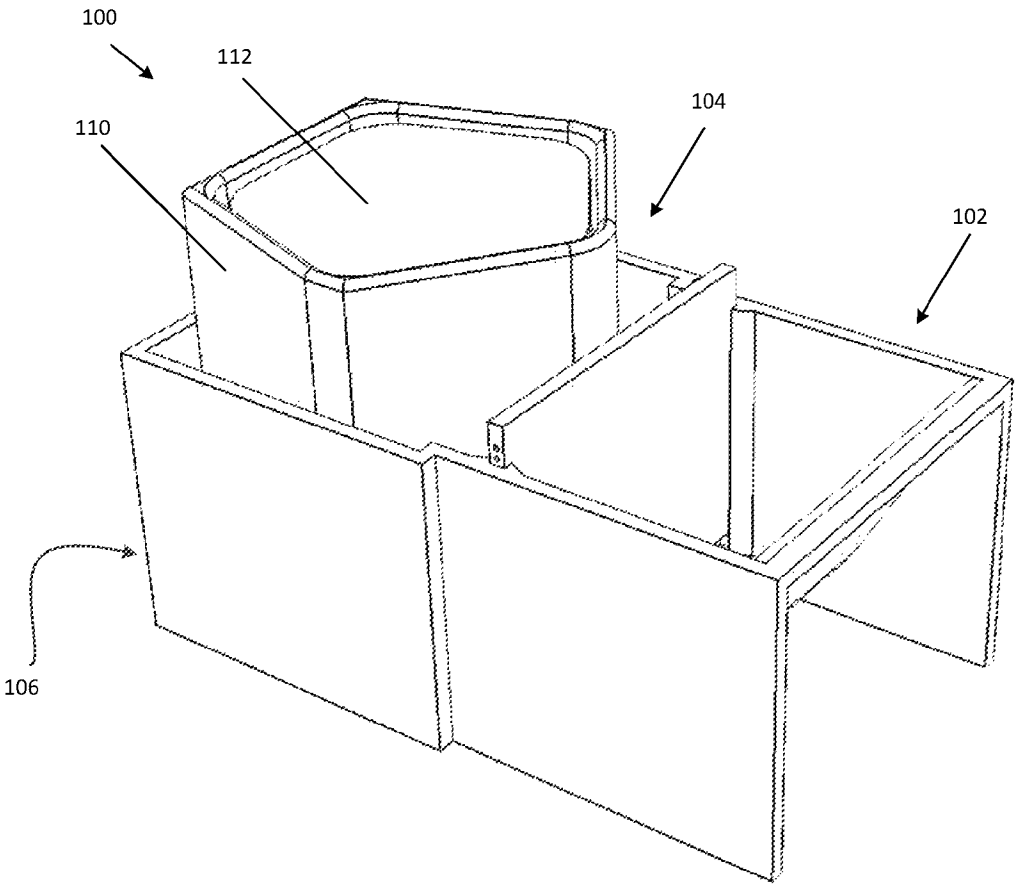
FIG. 1*a* shows a perspective view of an embodiment of the invention.

FIG. 1*a* shows a perspective view of an embodiment of the invention. This embodiment of a solid product dispenser 100 comprises an inlet portion 102, which receives an incident fluid, a reaction portion 104, in which the fluid encounters the solid product, and an outlet portion 106, from which the solution of the two is dispensed. The reaction portion comprises a solid product 112 intended for dissolving in a fluid to create a solution. Fluid is introduced into this embodiment by being supplied to the inlet portion 102. From there, it flows into the reaction portion, where it comes into contact with the solid product. Fluid dissolves contacting portions of the solid product 112, which then dissolves into the fluid, thereby creating a solution. This solution continues through the reaction portion to the outlet portion, where it is dispensed from the invention. The embodiment of the invention shown in FIG. 1*a* further comprises a product guide 110, which is housed at least partially within the reaction portion and is configured to hold the solid product. Particular embodiments of the invention may be designed to hold a particular product, which may be shaped in a particular defining way. Thus, the product guide of various embodiments may be uniquely shaped so as to receive a particular solid product.

While the product 112 and product guide 110 of FIG. 1*a* are shown as pentagonal, they could just as well by any other shape, such as triangular, hexagonal, or rectangular. In some embodiments of the invention, the shape of the solid product is indicative of the solid product itself. For example, a pentagonal product may comprise a detergent, a hexagonal product may comprise a sanitizer, and a square product may comprise a floor care product. Accordingly, different embodiments of the invention may be used for different desired applications, as the shape of the product guide may indicate the desired product of use. Additional embodiments of the invention may comprise a product lockout, which may prevent a product of an incorrect shape, and therefore incorrect composition, from being used. Embodiments of the present invention may comprise various materials, for example metals, plastics, composite, etc. Further embodiments may comprise polypropylene.

Figure 1B:
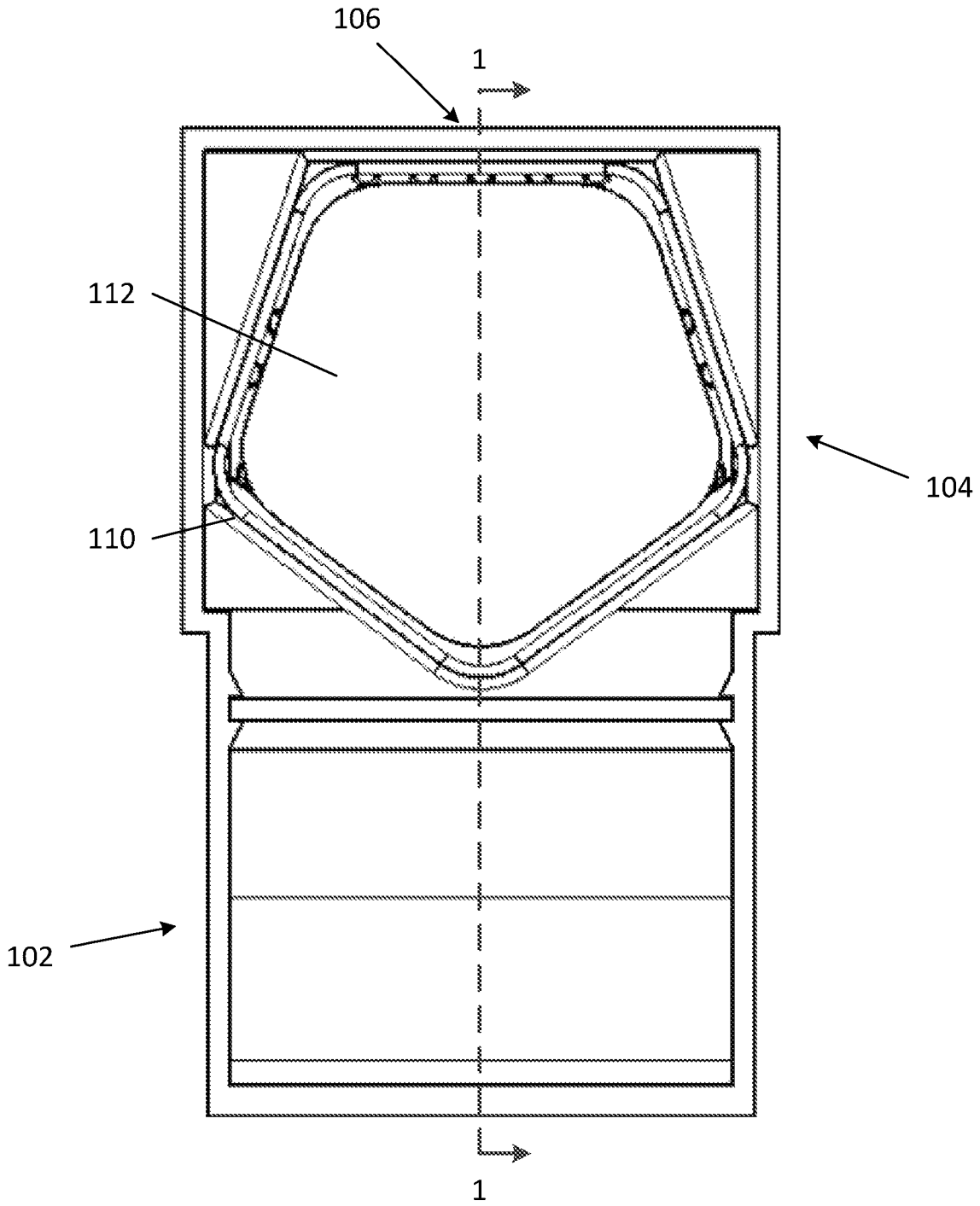
FIG. 1*b* shows a top-down view of an embodiment of the invention similar to the one illustrated in FIG. 1*a*.

FIG. 1*b* shows a top-down view of an embodiment of the invention similar to the one illustrated in FIG. 1*a*. Shown is the inlet portion 102, the reaction portion 104, and the outlet portion 106, as well as the product guide 110 and solid product 112. FIG. 1 *c* shows a cross-sectional view of the embodiment of FIG. 1*b*, taken at line 1-1 in FIG. 1*b*. As shown, this embodiment further comprises a lead-in ramp 114 as part of the inlet portion 102, such that fluid incident to the inlet portion 102 impinges on the lead-in ramp 114. Fluid then flows down the lead-in ramp 114 into the reaction portion 104. The lead-in ramp 114 may provide a surface oriented at an angle to the fluid incident to the inlet portion 102. In this case, the angular relationship may minimize undesired splashing of the fluid either out of the dispenser or onto the solid product 112. Additionally, the lead-in ramp may comprise a textured surface to encourage the incident fluid to spread out as it travels towards the reaction portion. Some embodiments may also comprise a gate 116 in order to at least prevent undesired splashing of incident fluid onto the surface of the product 112. In some embodiments, the gate may additionally provide the boundary between the inlet portion and the reaction portion. In still further embodiments, the gate may additionally regulate the rate of flow of the fluid between the inlet portion and the reaction portion, and may be adjusted in height to change the rate of flow.

Figure 1C:
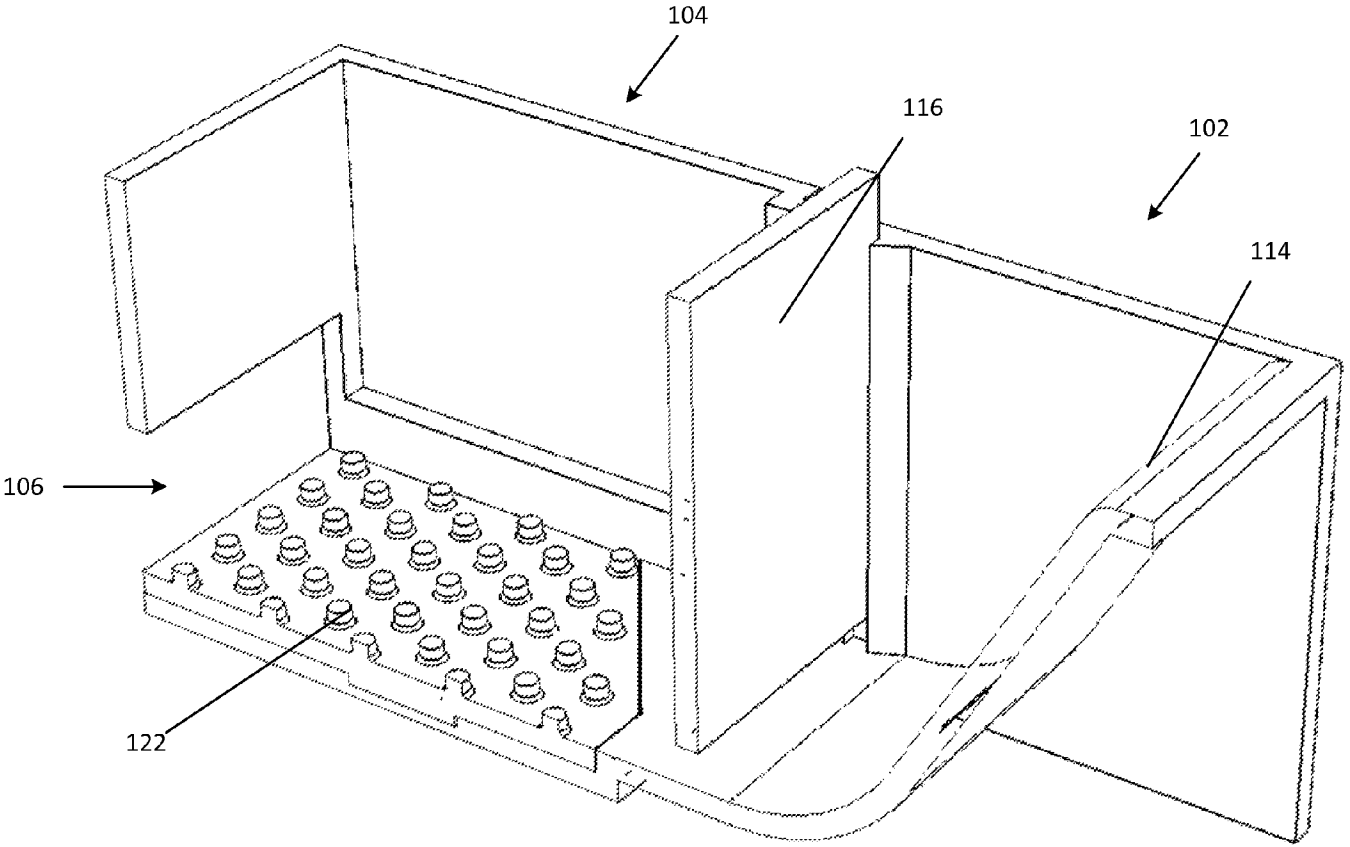
FIG. 1*c* shows a cross-sectional view of the embodiment of FIG. 1*b*, taken at line 1-1 in FIG. 1*b*.

In certain embodiments of the invention, the dispenser may comprise pegs 122, shown in FIG. 1*c* as being located on the bottom surface of the dispenser, intended to support the solid product 112 above the floor of the reaction portion 104 as fluid flows through the spaces therebetween. Ideally, in operation, the pegs 122 are shorter than the depth of the fluid so that the fluid will contact at least a portion of the solid product 112 as it flows through the pegs 122. Taller pegs 122 will support the product 112 further above the base of the dispenser than will shorter pegs 122, thereby supporting the product 112 further out of the fluid and changing the amount of surface contact therebetween. Peg heights may be optimized in a laboratory or factory prior to implementation into the dispenser so that a desired amount of interaction between the solid product 112 and the fluid may occur depending on a either a specific incident fluid flow rate or a particular range thereof. Adjustable or interchangeable pegs are also contemplated, allowing the end user to change the height of the pegs 122. Pegs 122 may also be affixed to a peg plate, which may itself be entirely replaceable by the user. The number or area density of pegs may vary from embodiment to embodiment; however it will be appreciated that a lower number of pegs will result in more mass of the solid product per surface area of pegs, potentially creating a risk for the solid product 112 to sink down onto the pegs 122 and embedding them therein. Too many pegs 122, however, may inhibit the ability for fluid to flow through the dispenser. After flowing through the pegs 122 and contacting the solid product 112, fluid may exit the dispenser through the outlet portion 106 via an opening to the outside of the dispenser.

Figure 3:
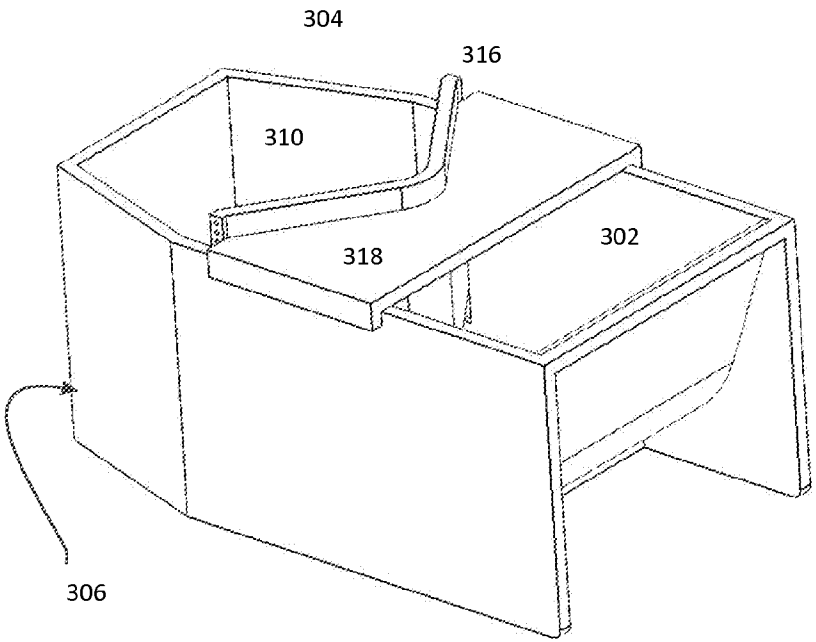
FIGS. 2 and 3 show alternative embodiments of the invention.
Figure 2:
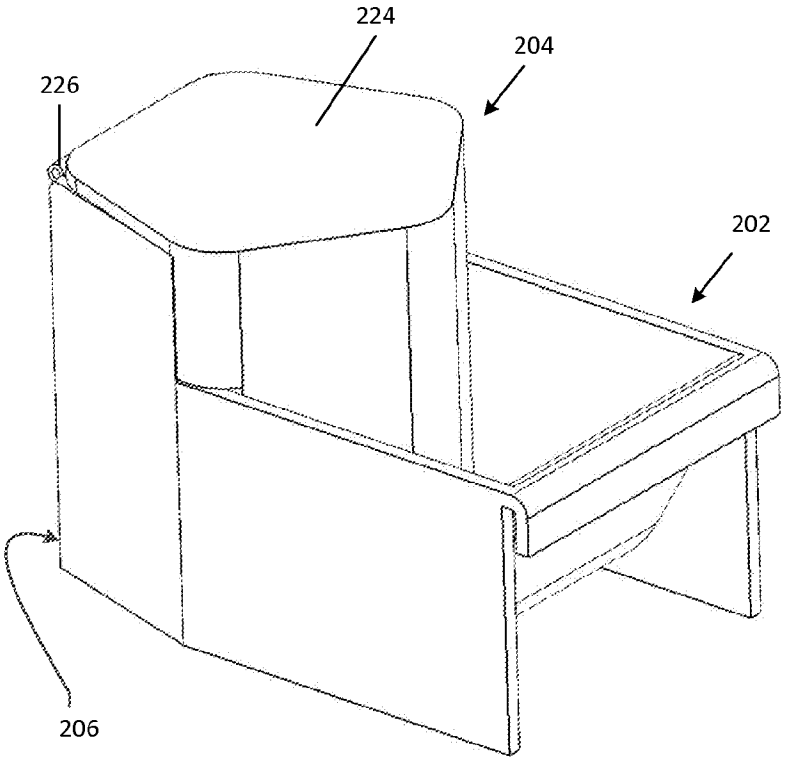

FIGS. 2 and 3 show alternative embodiments of the invention. The dispenser of FIG. 2 further comprises a closable lid 224 which, when closed, covers the solid product within the reaction portion 204. In some embodiments, the lid covers the top and the side of the solid product facing the inlet portion 202, shielding it from undesired exposure to the incident fluid such as splashing from the inlet portion 202 or incorrect operation of the dispenser. The lid 224 may be attached to the dispenser by attachment means, such as a hinge 226 or other method of attachment known in the art, or it may be entirely removable from the dispenser. FIG. 3 shows an embodiment of the invention with no lid, but further comprising a splash guard 318. Splash guard 318 acts in conjunction with gate 316 to prevent undesired fluid from coming into contact with the solid product by blocking fluid that may otherwise splash up and over the gate The concentration of the solid product in the solution formed is dependent upon several factors. Fluid temperature and flow rate, as well as the amount of solid product contacting the fluid and any specific chemistry therebetween, may affect the concentration of the solution. Desired concentrations may vary from application to application, however it is advantageous to be able to both achieve and maintain a desired concentration. Thus, in some embodiments, it is preferred that the solid product be dissolved uniformly across the bottom surface by the fluid. This may be advantageous since otherwise, non-uniform dissolution may cause surface deformations on the solid product, resulting in a change of surface area exposed to the incident fluid. This may then result in undesired changes in the concentration of the solid product in the solution.

Figure 4B:
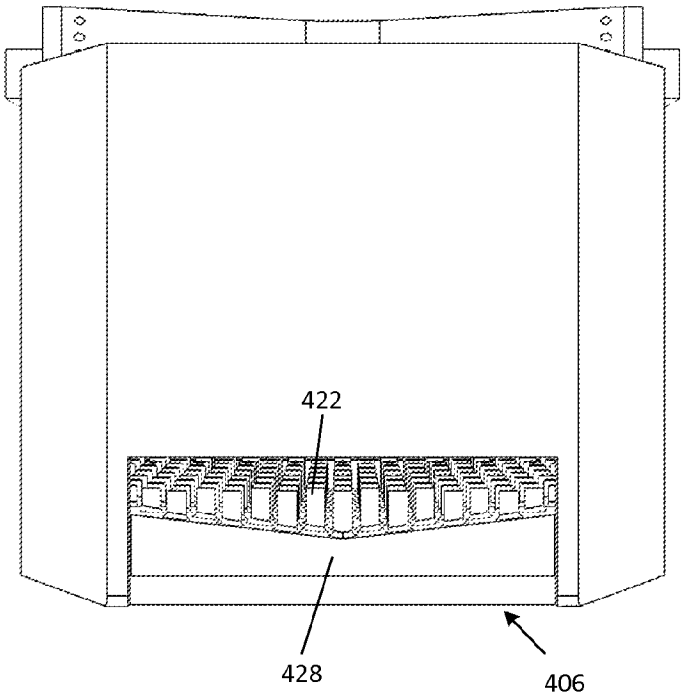
FIG. 4*b* shows an elevational view of an embodiment of the invention
Figure 4A:
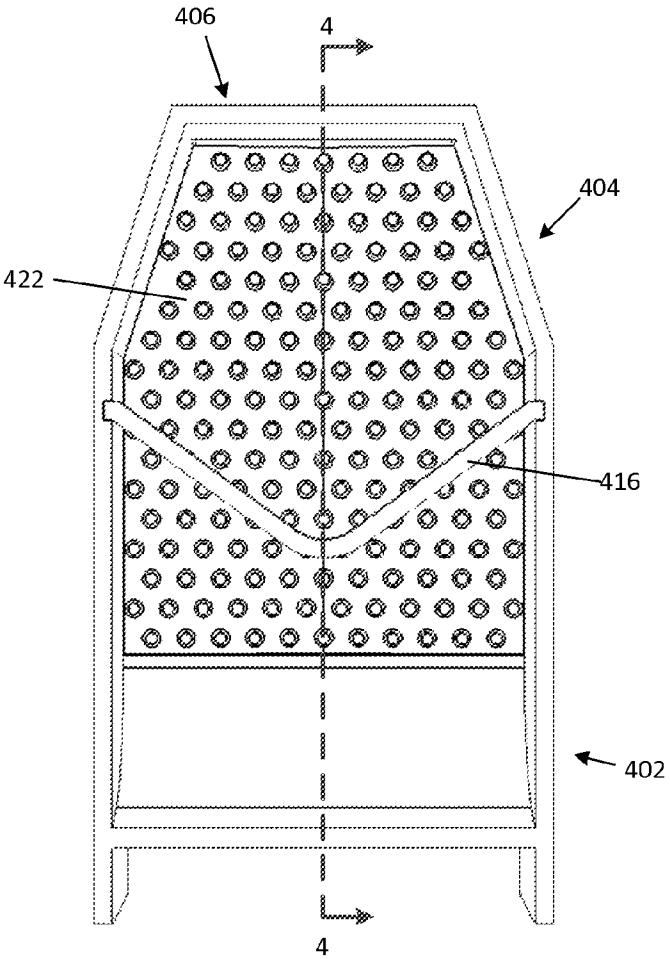
FIG. 4*a* shows a top view of an embodiment of the invention.

FIGS. 4*a* and 4*b* show embodiments of the invention comprising components aimed to create and/or maintain uniform dissolution of the solid product substantially across a single surface. FIG. 4*a* shows a top view of an embodiment of the invention. As was the case with the embodiment illustrated in FIG. 1*c*, the embodiment of FIG. 4*a* comprises pegs 422 on the bottom surface of the dispenser, however these pegs 422 can be seen to extend beyond the perimeter of the gate 416, which encloses the solid product, towards the inlet portion, providing pegs in the dispenser not supporting the solid product, but rather "upstream" from the product. As fluid enters the dispenser via the inlet portion and is initially incident on the front surface of the pegs 422, turbulence may be created, resulting in upward displacement of the incident fluid. Were the solid product 412 to be situated on these pegs, the upwardly displaced fluid may come into contact with the product and cause non-uniform and/or undesired erosion. Thus, in this embodiment, the pegs 422 extend outside of the area where the solid product is to be held so that this initial contact with the pegs, and its induced turbulence and potential upward displacement of fluid, may occur prior to the fluid reaching the product, by which time the fluid may reach a steady state flow pattern. In this embodiment, three rows of pegs 422 are located between the inlet portion and the nearest point of the gate.

In other situations, fluid dynamics within the dispenser may cause width-wise non-uniform flow rates across the reaction portion. In some instances, for example, the product erodes more quickly near the edges of the dispenser as compared to in the center, suggesting perhaps faster, preferred fluid flow around the edges. FIG. 4*b* shows an elevational view of an embodiment of the invention intended to help fix such non-uniformity. Shown is the outlet portion 406 of the dispenser from where the solution is dispensed. Through the outlet portion 406, the pegs 422 are visible, as is the base of the reaction portion of the dispenser, referred here to as the hull 428; however the hull need not be limited to the base of the reaction portion. In this embodiment, the hull 428 comprises a V-shaped hull 428*a*, as its cross-section resembles that of the letter "V". The V-shaped hull 428*a* acts to draw more fluid from the edges of the dispenser towards the middle while fluid is flowing through the reaction portion. This reduces the enhanced erosion nearer the edges described previously, resulting in a more uniform dissolution process across the bottom surface of the solid product and a greater likelihood of maintaining a desired concentration during operation. It will be appreciated by one skilled in the art that the 'V' shape of the hull shown herein is not the only shape that may be used to accomplish such a process. Other hull shapes are contemplated such as a "U" shape, a parabolic shape, or any other shape that may divert some of the fluid flow away from the edges and towards the central pathway from the inlet to the outlet.

Figure 4C:
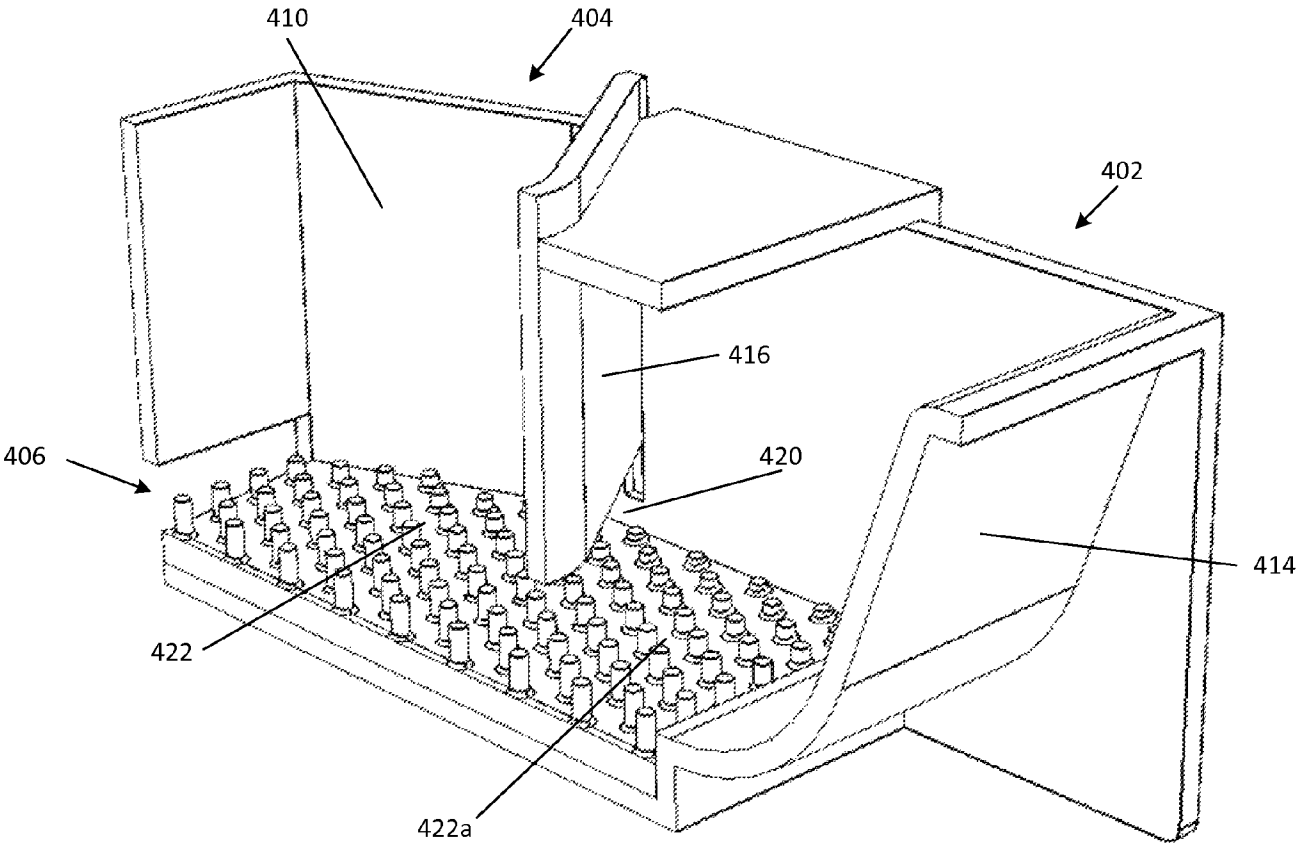
FIG. 4*c* is a cross-sectional perspective view an embodiment of the invention, taken at line 4-4 in FIG. 4*a*.

FIG. 4*c* is a cross-sectional perspective view an embodiment of the invention comprising features illustrated in FIGS. 4*a* and 4*b*, with the cross section taken at line 4-4 in FIG. 4*a*. In this embodiment, the fluid enters the inlet portion 402 which comprises a lead-in ramp 414. The fluid contacts and flows down the lead-in ramp 414, which directs the fluid towards pegs 422 along the bottom of the dispenser. The fluid contacts a first series of pegs 422, which may induce turbulence into the fluid. It is assumed, however, that after the fluid has passed the first series of pegs 422, much of the induced turbulence will have substantially subsided, resulting in generally steady state fluid flow beyond this point. In some embodiments, this first series of pegs comprises at least three rows of pegs in order to provide a sufficiently long flow path for the fluid flow to reach a steady state. Beyond the first series of pegs 422, fluid ideally flows in a steady-state through a gap 420 under the gate 416 and into the area surrounded by the product guide, configured for holding the solid product atop the pegs 422 therein. With a solid product in place in the product guide 410, fluid contacts the solid product and erodes it, forming a solution of the product in the fluid. The solution then flows to the outlet portion 406, where it exits the dispenser. Embodiments such as the one shown in FIG. 4*c* may additionally comprise a hull such as the aforementioned V-shaped hull 428*a* to aid in uniform dissolution of the solid product. While the reaction portion of FIG. 4*c* is designed to hold a product of a particular shape, it will be appreciated that embodiments similar to the one shown in FIG. 4*c* may be configured for receiving products of differing shapes.

While the embodiments illustrated in the figures described thus far have featured fluid flow generally in one linear direction, other embodiments of the invention may comprise other flow patterns as well. For example, fluid may enter the dispenser via an inlet portion and flow into the reaction portion in a first direction and flow out of the outlet portion in a second direction, different from the first. It will be appreciated by those skilled in the art that many configurations fall within the scope of the invention. Another such alternate configuration is described below.

Figure 5A:
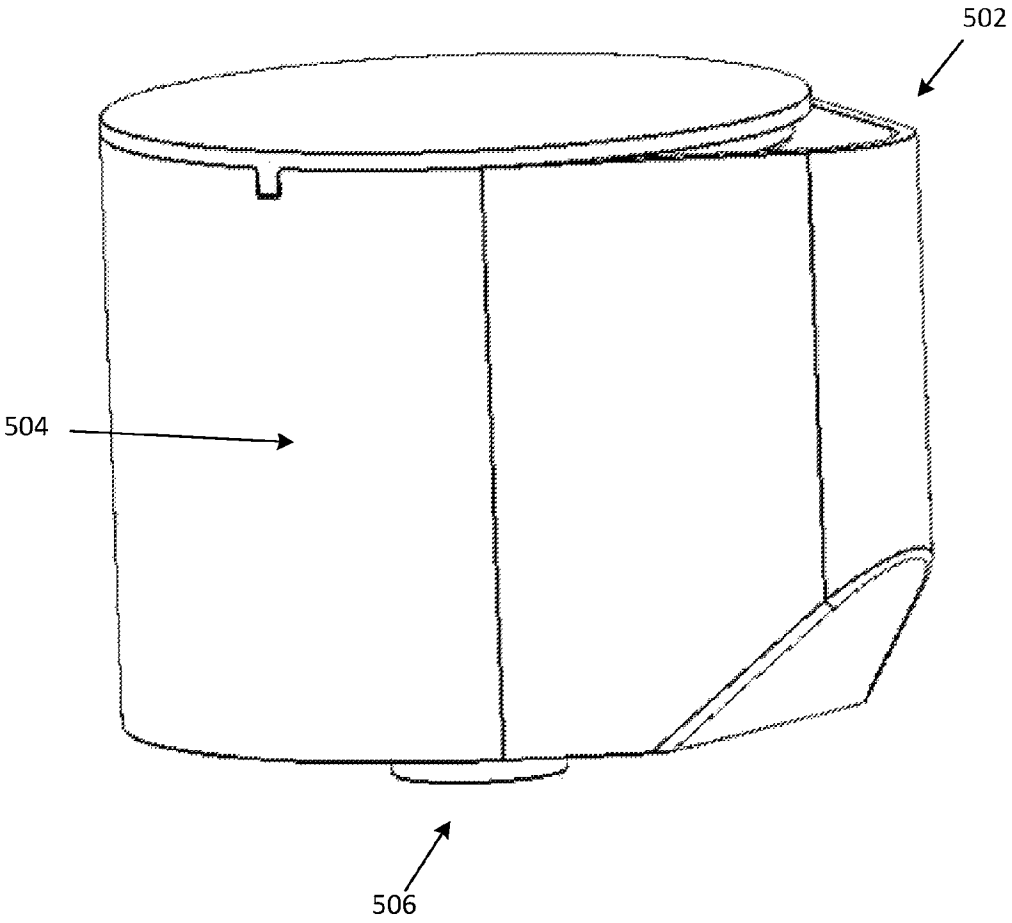
FIG. 5*a* is a perspective view of an alternative embodiment of the invention.
Figure 5B:
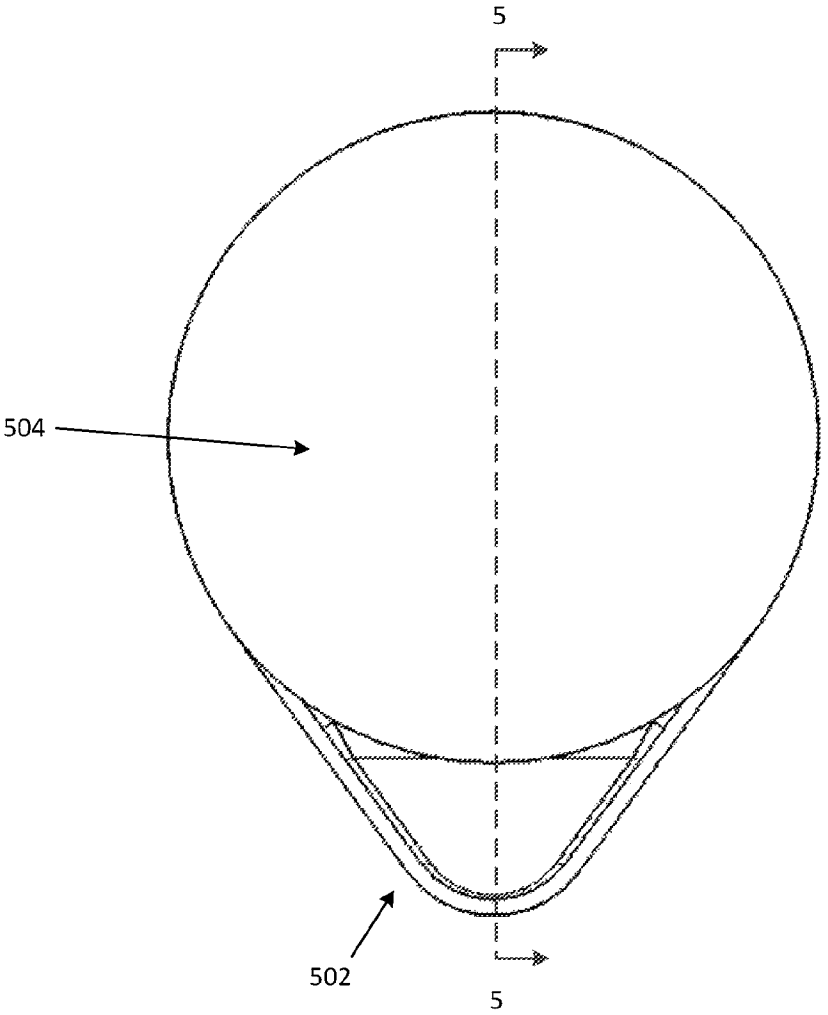
FIG. 5*b* is a top-down view of the embodiment of the invention of FIG. 5*a*.
Figure 5C:
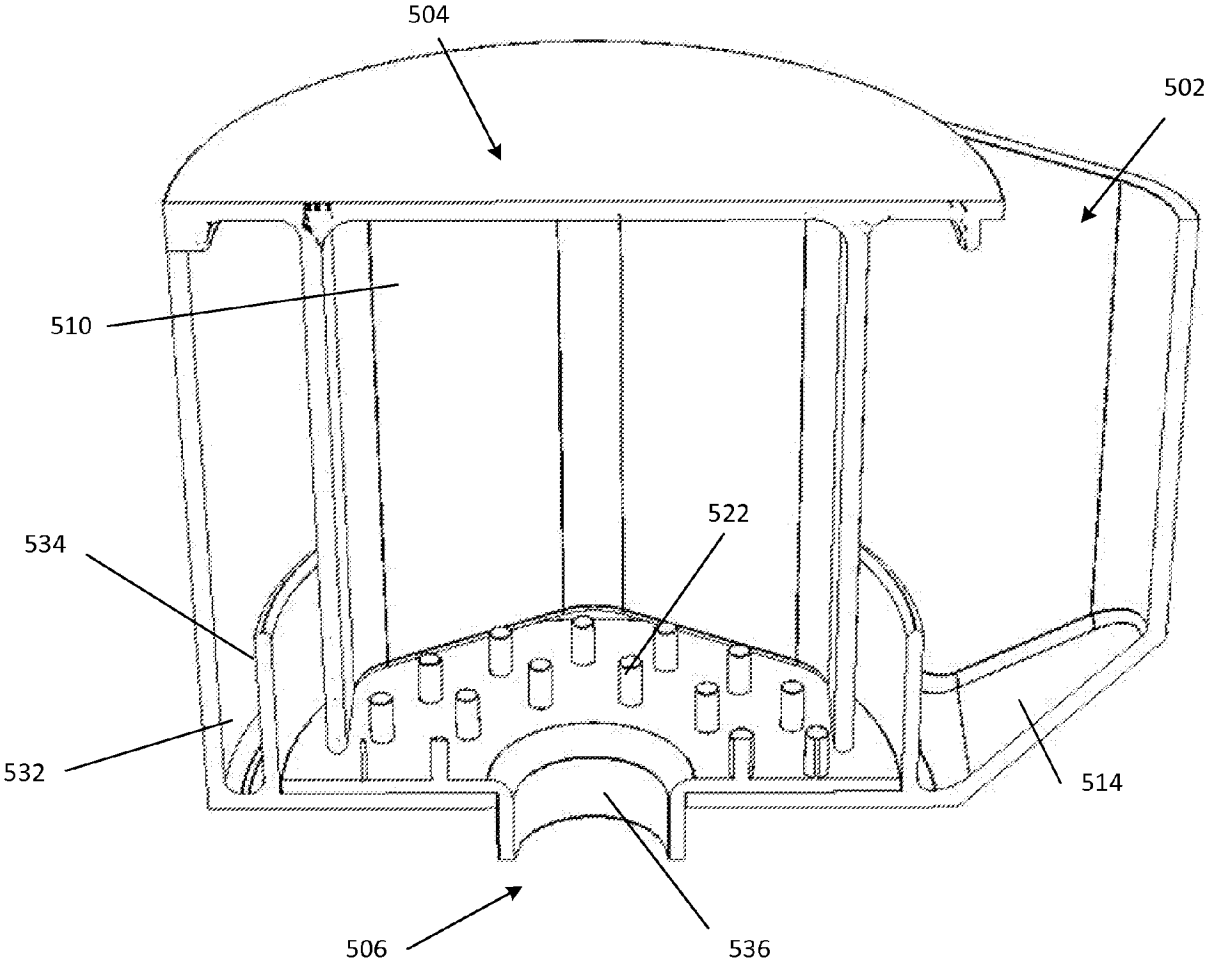
FIG. 5*c* is a cross-sectional view of the embodiment, taken at line 5-5 in FIG. 5*b*

FIGS. 5*a*, 5*b*, and 5*c* illustrate yet another embodiment of the invention, comprising inlet 502, reaction 504, and outlet 506, portions. FIG. 5*a* is a perspective view of an embodiment of the invention, showing the inlet 502, reaction 504, and outlet 506 portions. FIG. 5*b* is a top-down view of the embodiment of the invention of FIG. 5*a*, and FIG. 5*c* is a cross-sectional view of the embodiment, taken at 5-5 in FIG. 5*b*. In this embodiment, fluid is received via inlet portion 502, where it contacts lead-in ramp 514. Fluid flows down the ramp 514 and into an annular channel 532 formed by a wall 534. With nowhere else to flow, the fluid accumulates in the annular channel 532, causing the fluid level to rise. Once the fluid level has reached the height of the wall 534, additional fluid added to the inlet portion 502 will cause fluid in the annular channel 532 to spill over the wall 534 and into the reaction portion 504 of the dispenser. Fluid flows under the confines of the product guide 510, which houses a solid product supported by an arrangement of pegs 522. Fluid flows through pegs 522 while contacting at least a portion of the solid product supported thereon. The fluid erodes the product, which then forms a solution with the fluid. Finally the solution flows out of the outlet portion 506 of the dispenser via the output drain 536. It is important that the output drain 536 be large enough to permit a sufficient flow rate out of the dispenser, lest the fluid level rise and contact more surface of the solid product 512 or flood the dispenser.

The embodiment described above allows the fluid to impinge on each side of the solid product, as the fluid will fill the annular channel uniformly and spill over and flow towards the product on all sides, provided the wall height is uniform. This is in contrast to the substantially single-dimensional flow patterns of the previous embodiments, and may contribute to a more even pattern of dissolution across the solid product. While the embodiment of FIG. 5*c* suggests a circular (annular) channel, other shapes may also be used. As described above, various solid products may be shaped in various defining ways, and thus, it may be that to receive a particular desired product, the channel and/or wall forming the channel may be shaped similarly to the desired product, or arranged in any other shape.

Various embodiments of the invention have been described. In a common configuration, an embodiment of the invention may be used in conjunction with a three-compartment sink; wherein different solutions are desired in each compartment for a multi-step procedure, for example washing dishes. In such a configuration, a first embodiment of the invention may be configured to dispense a solution comprising a first solid product into a first compartment of the sink, while a second embodiment of the invention may be configured to dispense a solution comprising a second solid product into a second compartment of the sink. Thus, using the sink, a user may apply a fluid, such as water conveniently supplied by the sink, to each of the embodiments of the invention, thereby dispensing the desired first and second solutions in separate compartments of the sink. For example, in a three compartment sink, embodiments of the invention could be used to produce a detergent solution in the first compartment of the sink and a sanitizer solution in the third compartment while leaving only water in the second compartment, organizing the sink contents in order of use. Additional embodiments of the invention comprising additional solid products may be used in processes requiring additional solutions.

Embodiments of the invention may also comprise a mounting member for attaching the dispenser to or near a container for receiving the dispensed solution. For example, the dispenser may be attachable to the edge of a sink via the mounting member so that as a solution flows out of the outlet portion, it flows directly into the sink. It may additionally be attached such that the faucet of the sink conveniently directs fluid into the inlet portion of the invention. The dispenser may also be mounted on an alternative container such as a mop bucket, for example. In this exemplary configuration, the dispenser may be mounted on the mop bucket and arranged so that a created solution such as a floor cleaning solution flows directly into the bucket. Other embodiments of the invention may enable the mounting of the dispenser to a wall in a location that may be proximate a fluid source. In such a configuration, the fluid source may supply fluid to the inlet portion of the dispenser, and the solution may flow out of the outlet portion into any number of desired locations, such as a sink compartment or a bucket. Furthermore, embodiments of the invention configured for holding various solid products (comprising differently shaped product guides, for example) may have similar or like mounting members, allowing for these embodiments to be interchangeably mounted on a container, wall, or other mounting location appreciated by those skilled in the art.

It has been previously noted that various factors may contribute to the concentration of the solution dispensed from the invention. Oftentimes there may be a certain range that the concentration is desired to fall within. Accordingly, elements of the invention may be adjusted in a factory or laboratory setting in order to achieve a concentration within the desired range for a particular operating condition. Moreover, elements may be optimized in order to achieve a concentration within a desired range for any in a range of typical operating conditions, for example a temperature range of 90-140 degrees Fahrenheit with a flow rate in the range of four to eight gallons-per-minute. Among others, elements that may be optimized include peg size, shape, and number density, along with the shape and depth of the hull. Those skilled in the art will appreciate that modification and optimization of additional components of the invention may also accomplish desired changes in the concentration.

As shown in the illustrated embodiments and described above, the product guide may be shaped such that it receives a particularly shaped solid product. Often, this solid product is of the same shape as the product guide, as shown in the pentagonal configuration of FIG. 1*a*, and further prohibits differently shaped products, such as a hexagonal product, from entering the product guide. Different embodiments of the invention may further be configured to hold stacks of multiple solid product blocks, wherein two pentagonal shaped product blocks may be stacked on one another in the product guide, for example. Maintaining a stack of at least two product blocks in the product guide may be advantageous, since if the first dissolves completely, there remains product available to dissolve and form the solution. Otherwise fluid may enter the dispenser, encounter no product block, and continue out of dispenser substantially unchanged.

Various embodiments of the invention have been described. It should be known that the embodiments described herein are exemplary in nature and in no way limit the scope of the invention. Rather, they serve as examples illustrating various features and embodiments thereof. These and other embodiments are within the scope of the following claims.

The invention claimed is:

1. A method for dispensing a solution of a solid product, the method comprising:

providing a stand-alone, free-flowing product dispenser, the dispenser comprising:

an inlet portion for receiving liquid, a reaction portion in which the solution is formed, the reaction portion in communication with the inlet portion and configured to receive a solid product, and an outlet portion for dispensing the solution, the outlet portion in communication with the reaction portion; and directing liquid through the dispenser from the inlet portion to the outlet portion, whereby the liquid first comes into contact with a first group of pegs and then comes into contact with a second group of pegs, the first group of pegs not supporting the solid product and the second group of pegs supporting the solid product and spaced downstream from the first group of pegs, the liquid comes into contact with the solid product supported on the second group of pegs and dissolves said product, thereby creating a solution of the liquid and the product; and the solution is dispensed from the outlet portion.

2. The method of claim 1, wherein the liquid flows through the spaces between the first and second groups of pegs.

3. The method of claim 2, where the first group of pegs is located within the inlet portion such that the liquid contacts and flows through the first group of pegs prior to encountering the solid product supported on the second group of pegs.

4. The method of claim 1, wherein the dispenser comprises a V-shaped hull substantially beneath the solid product in order to direct liquid flow to more evenly dissolve the cross-section of the solid product.

5. The method of claim 1, wherein the liquid contacts a wall substantially surrounding the solid product and accumulates in a channel partially formed by the wall prior to contacting the solid product.

6. The method of claim 5, wherein the liquid accumulates until it flows over the top of the wall and subsequently contacts the solid product.

7. The method of claim 6 wherein the liquid contacts the solid product from all sides of the solid product.

8. The method of claim 1, wherein the inlet portion comprises a lead-in ramp, and wherein directing liquid through the dispenser from the inlet portion further comprises directing liquid down the lead-in ramp, where the lead-in ramp is an angled surface.

9. The method of claim 1, wherein the dispenser further comprises a gate forming a boundary between the inlet portion and the reaction portion, the reaction portion in communication with the inlet portion when the gate is in a raised position.

10. The method of claim 9, wherein directing liquid through the dispenser from the inlet portion to the outlet portion further comprises controlling a flow rate of the liquid through the reaction portion by adjusting the raised position of the gate.

11. The method of claim 1, wherein the liquid coming into contact with the first group of pegs further comprises the liquid passing through three rows of pegs.

* * * * *